United States Patent [19]

Berger et al.

[11] Patent Number: 4,674,457

[45] Date of Patent: Jun. 23, 1987

[54] DRY SUMP CRANKCASE

[75] Inventors: Alvin H. Berger, Wyandotte; Roy E. Diehl, Northville, both of Mich.

[73] Assignee: Ford Motor Company, Dearborn, Mich.

[21] Appl. No.: 869,516

[22] Filed: Jun. 2, 1986

[51] Int. Cl.[4] ..... F01M 1/00

[52] U.S. Cl. ..... 123/196 R; 123/572

[58] Field of Search ..... 123/572, 196 R, 195 R, 123/195 C; 184/106, 6

[56] References Cited

U.S. PATENT DOCUMENTS

| | | | |
|---|---|---|---|
| 1,876,948 | 9/1932 | Jahnke | 123/195 C |
| 2,983,334 | 5/1961 | Dalrymple | 123/195 C |
| 3,730,149 | 5/1973 | Brown | 123/572 |
| 3,929,117 | 12/1975 | Greene | 123/572 |
| 4,270,497 | 6/1981 | Valerio | 123/195 C |
| 4,287,861 | 9/1981 | Lehner | 123/195 C |
| 4,378,763 | 4/1983 | Ishihama | 123/196 R |
| 4,523,556 | 6/1985 | Suzuki | 123/196 R |
| 4,524,735 | 6/1985 | Bauder | 123/196 R |
| 4,616,609 | 10/1986 | Munch | 123/196 R |

*Primary Examiner*—Ronald B. Cox

*Attorney, Agent, or Firm*—Robert E. McCollum; Clifford L. Sadler

[57] ABSTRACT

An engine oil pan of the dry sump type is divided into inner and outer parts by a funnel-like baffle with a hole in the bottom, the hole being of a controlled vertical height, the outer part being an oil reservoir connected to the engine suction side of the engine positive crankcase ventilating (PCV) system, the inner part receiving the oil therein from the various engine parts and being connected to the fresh air inlet side of the PCV system, thereby, during normal engine operation, establishing a constant pressure differential across the baffle to force oil collected in the inner part through the hole into the outer part, the oil level in the inner part stabilizing at the level of the hole in the baffle, the oil in the outer part stabilizing at a level dependent upon the total quantity of oil in the system and the volume of the reservoir, thereby removing standing oil from the vicinity of the moving parts in the crankcase which reduces friction and aeration of the oil and yet provides an adequate supply of oil to the engine oil pump.

5 Claims, 5 Drawing Figures

DRY SUMP CRANKCASE

This invention relates in general to the crankcase of an automotive type internal combustion engine and more particularly, to one of the dry sump type.

It is a primary object of the invention to provide a dry sump type crankcase that will remove standing oil from the vicinity of the moving components in the crankcase to reduce friction and oil aeration and yet assure an adequate oil supply to the oil pump. This is accomplished by the use of a two-part oil pan or crankcase. The inner part underlies the moving components of the engine and collects oil for drainage and passage into the outer part, which constitutes an oil reservoir. The flow between the two is continuous with the oil being displaced from the inner part to the oil reservoir against gravity in response to a pressure differential between the two resulting from a connection of the oil reservoir to the engine positive crankcase ventilating (PCV) system .

Dry sump ventilating systems are known. U.S. Pat. No. 3,929,117, Green et al, shows an oil pan consisting of an oil reservoir with baffles for directing oil into the reservoir, and the use of a PCV system to ventilate the crankcase. In this case, the baffle serves only as an oil-/air separator, and the PCV system serves only to ventilate the crankcase and not to displace oil against gravity. There is no constant pressure differential across the opening to the oil reservoir to move the oil against gravity to a predetermined level below the moving components.

U.S. Pat. No. 1,876,948, Jahnke, shows the use of a separate oil reservoir 14 connected to the bottom of the crankcase by orificed openings 17 to maintain the lower part of the crankcase free of oil. U.S. Pat. No. 4,270,497, Valerio, uses an elongated windage tray with a skimmer bar to remove oil from directly beneath the moving parts of the crankcase into a separate oil reservoir. Neither of the above devices uses a pressure differential to displace the oil against gravity into the oil reservoir.

U.S. Pat. No. 2,983,334, Dalrymple, shows a two-cycle engine using pressure pulsations to open a one-way check valve and force oil into a reservoir and therefrom to the various bearings for lubrication thereof. However, the pressure is pulsating rather than constant and does not originate from a constant source such as the PCV system. Instead, check valves and/or rotary valves are used to store the crankcase pressure at different times.

None of the above prior art devices also uses a controlled opening in a baffle to regulate oil level. Therefore, it is an object of the invention to provide a dry sump type crankcase in which oil is continuously and automatically removed from the crankcase by use of the PCV system suction, crankcase pressure and gravity, that establishes a constant pressure differential across a baffle, corresponding to the difference in level of the oil between the inner and outer chambers of the oil pan. Standing oil is continuously removed from the vicinity of the moving components in the crankcase, thereby reducing friction and oil aeration while assuring an adequate oil supply to the oil pump.

Other objects, features and advantages of the invention will become more apparent upon reference to the succeeding, detailed description thereof, and to the drawings illustrating the preferred embodiment thereof wherein.

Figure 1:
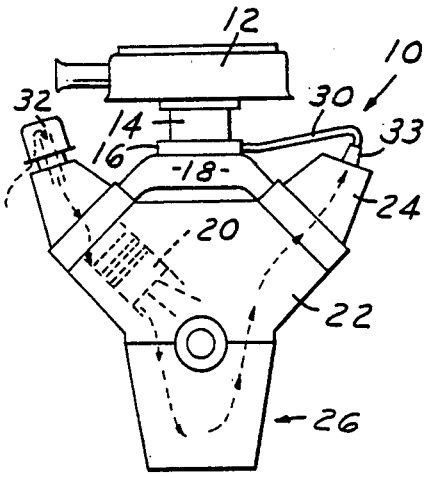
FIG.1 PRIOR ART
FIGS. 1 and 2 are end elevational views of an automotive type engine, FIG. 1 illustrating the prior art, and FIG. 2 embodying the invention.

FIG. 1 illustrates schematically a known V-8 type internal combustion engine 10. It has an air cleaner 12 controlling the flow of clean air to the induction passage of a carburetor 14. The carburetor is mounted by a flange 16 over the engine intake manifold 18. The engine per se includes the usual pistons 20 (only one shown) reciprocable in a cylinder block 22 to draw in an air/fuel mixture from the intake manifold 18 upon operation of a valve train enclosed by cover 24.

During operation of the engine, a variable amount of vapors and gases leak past piston 20 into the oil pan indicated at 26. To recapture these, a positive crankcase ventilation (PCV) system is provided that directs the gases back into engine intake manifold 18. More particularly, the carburetor flange 16 has a passage (not shown) that is connected by a tube 30 to the valve cover 24 and therefrom through various parts of the engine to the oil pan 26. During engine operation, the vacuum in the intake manifold forces a flow of ventilating air at atmospheric pressure through a filtered opening in the engine oil filler cap 32 past the valve train and piston 20 into the crankcase 26 and therefrom into tube 30. The tube in this instance contains a PCV valve assembly 33 that continuously meters the flow toward the engine of the blowby gasses and fumes without unduly affecting the air/fuel ratio of the mixture flowing into the engine.

As thus far described, the details of construction and operation of the engine and PCV system are conventional. Turning now to the invention, as seen in FIGS. 2–5, the oil pan in this instance is divided into inner and outer parts or chambers 40 and 42 by a semicircular, funnel-like baffle member 44. The latter is sealed to the oil pan at its outer perimeter 46 to prevent communication between the two parts except through a hole 48 (shown more clearly in FIG. 4) at the bottom of inner part 40. Hole 48, in this case, is of a controlled vertical height to establish a pressure differential between the inner and outer chambers, in a manner to be described, to positively evacuate oil against gravity from inner chamber 40 into outer chamber 42 at all times during operation of the engine.

More particularly, the outer part constitutes an oil reservoir into which the oil will flow by gravity as well as in response to the pressure differential across baffle 48. A pair of supplemental storage tanks or reservoirs 50 are secured to opposite sides of the main oil reservoir 42 in saddle like fashion for containing all of the oil evacuated from chamber 40 during operation of the engine. In this construction, the bottom of oil reservoir 42 is essentially contained within the radius (indicated by dotted lines 52) of the engine flywheel. This permits the bottom of the crankcase to be much higher than is usual in automotive type engines, such as is shown in FIG. 1, thus permitting a much higher ground clearance for the vehicle.

Figure 2:
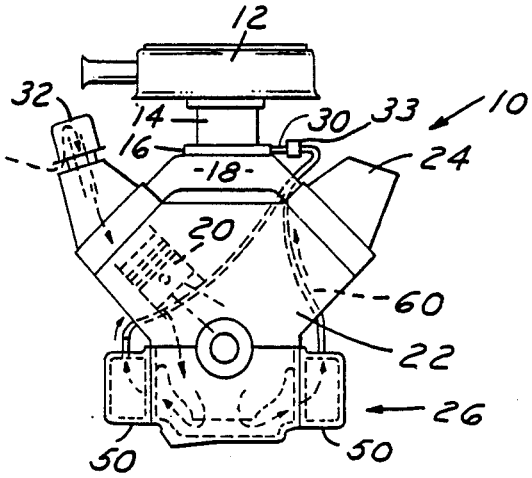
Figure 3:
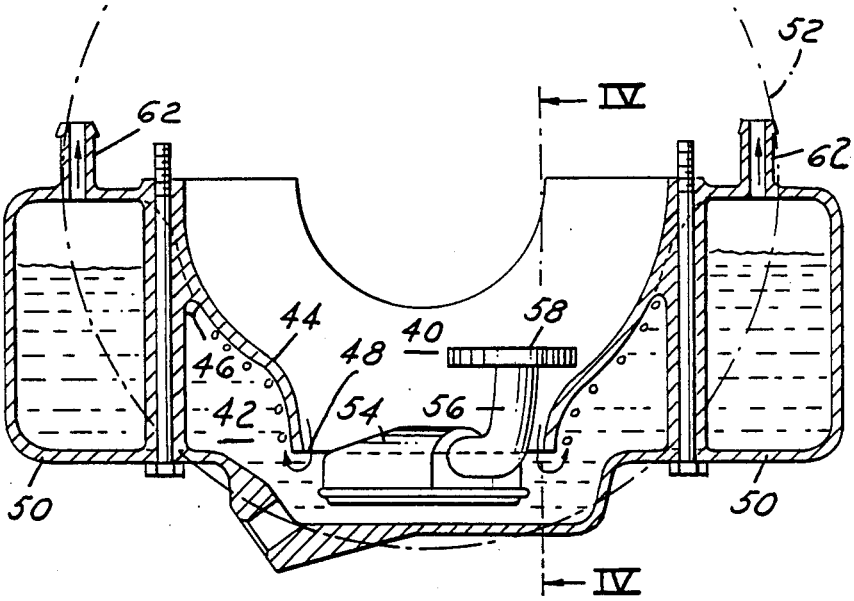
FIG. 3 is a view on an enlarged scale of a detail of FIG. 2, with parts broken away and in section.
Figure 4:
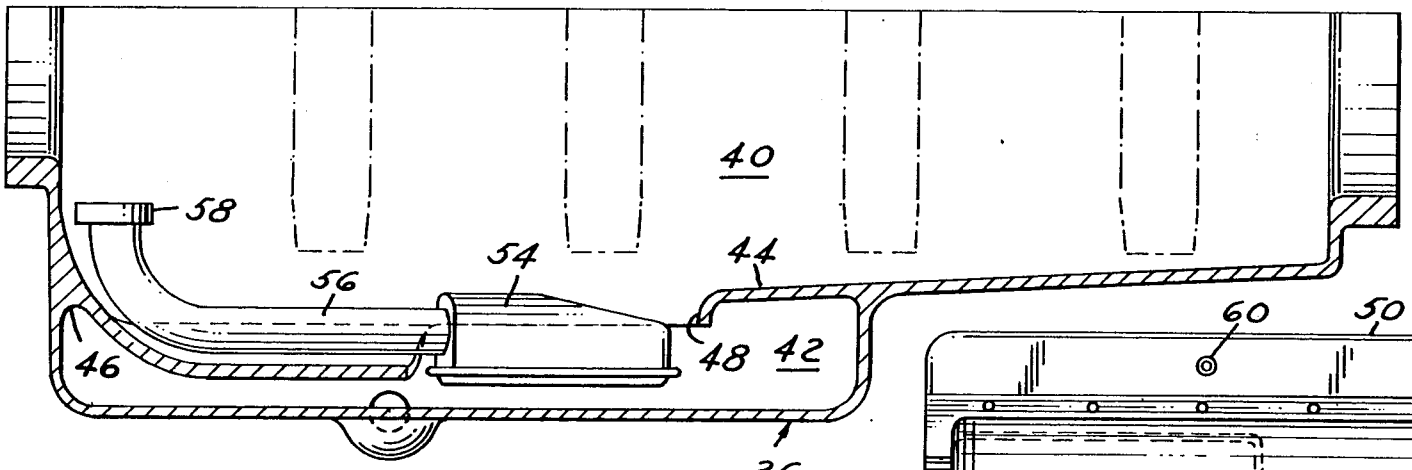
FIG. 4 is a cross-sectional view taken on a plane indicated by and viewed in the direction of the arrows IV—IV of FIG. 3.
Figure 5:
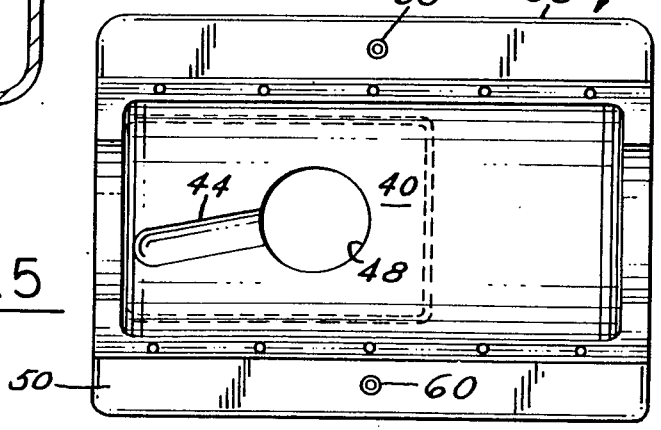
FIG. 5 is a plan view on a reduced scale of the engine oil pan embodying the invention.

While not essential, the screened inlet portion 54 for an oil pump and a part of its inlet tube 56 and associated connecting flange 58 may be located directly beneath the hole or opening 48, as indicated, for convenience. Finally, the PCV valve assembly 33 would be connected directly to the reservoirs 50, by tubing indicated by dotted lines 60 and fittings 62, as shown in FIG. 2, to subject the oil in the reservoirs to the engine intake manifold vacuum. Accordingly, the connections shown in FIG. 1 between the PCV valve assembly 33 and the engine rocker arm cover 24 then would be eliminated as indicated in FIG. 2.

As stated previously, when the engine is operating, the engine intake manifold vacuum creates a positive flow of air through the oil filler cap 32 down through the engine structure into the inner chamber 40 of the oil pan to act on the top of the oil in chamber 40. Simultaneously, the oil in the outer reservoir 42 and side chambers 50 is being acted upon by the engine suction through the PCV valve assembly 33 thereby creating a positive pressure differential between the surface of the oil in the inner chamber 40 and the side chamber 50. The PCV valve system is connected high into the outer part of the oil pan. The combination of PCV suction and crankcase blowby pressure now draws air out of the outer part of the pan, and oil from the inner part 40 of the pan then flows through the hole 48 into the outer part 42. When the oil level drops to the edge of the hole 48, air then can pass through the hole in the oil reservoir to the PCV system. This decays the pressure differential and causes the oil level then to hunt back and forth seeking an equilibrium position until the pressure differential is stabilized, maintaining the oil level at the height of the opening 48 so long as the engine is operating. When the engine is shut down, of course, the pressure differential will decay and the oil will seek its own level, moving into the inner cavity or chamber 40 to a level equal to that in the side chambers 50. In the event that after shutdown it is desired to maintain the oil level at the level of opening 48, a check valve (not shown) could be added to the PCV system to maintain the vacuum acting on the oil in chambers 42 and 50 and consequently maintain the same oil level even though the engine is not running. This would keep standing oil out of the crankcase chamber 40 and out of the path of moving components to reduce friction during engine cranking. If a greater oil capacity is desired than that provided by the outer reservoir 40 and side parts 50, a remote reservoir could be added with appropriate connections.

From the foregoing, therefore, it can be seen that the invention provides a dry sump type crankcase that automatically and continuously removes oil from the vicinity of the moving components in the crankcase, thereby reducing friction and oil aeration while assuring adequate oil to the oil pump, this being accomplished by a connection of the reservoir to the PCV system to assure a positive pressure differential between the crankcase and reservoir at all times during engine operation.

While the invention has been shown and described in its preferred embodiment, it will be clear to those skilled in the arts to which it pertains that many changes and modifications may be made thereto without departing from the scope of the invention.

We claim:

1. A dry sump type crankcase for an automotive type internal combustion engine having an intake manifold and a positive crankcase ventilation (PCV) system for automatically and continuously ventilating the crankcase, the system including an essentially atmospheric pressure fresh air inlet to the engine passing air therethrough to the crankcase and a connection from the oil pan to the vacuum in the intake manifold establishing a constant flow of crankcase vapors therebetween, the oil pan having a baffle therein partitioning it into an inner oil collecting funnel-like crankcase cavity and an outer oil reservoir, the inner cavity having an opening at its lowermost point for communication of oil with the reservoir, the opening being of a controlled vertical height for creating a pressure differential across the baffle during operation of the engine, and means connecting the inner cavity to the air inlet pressure side of the PCV System while connecting the reservoir to the vacuum side of the PCV system for establishing a constant pressure differential across the baffle sufficient to displace the oil against gravity and maintain the oil level in the crankcase during operation of the engine at the height of the opening in the baffle, gravity causing the oil to seek a level higher than the opening upon shutdown of the engine and the consequential decay of vacuum in the intake manifold.

2. An oil pan as in claim 1, the engine having a flywheel secured thereto, the lower extremity of the oil pan being essentially within the diameter of the flywheel.

3. An oil pan as in claim 1, the reservoir including a pair of vertically extending reservoir extensions projecting from opposite sides of the reservoir in saddle like fashion and each connected to the vacuum side of the PCV System for containing oil to a level higher than the baffle opening.

4. An oil pan as in claim 1, the reservoir including an oil pump inlet located directly beneath the opening.

5. An oil pan as in claim 1, the PCV System including a PCV valve movable in response to changes in intake manifold vacuum to regulate the flow of PCV gases and vapors at essentially a constant rate into the engine and thereby from the crankcase.

* * * * *